US005281488A

United States Patent [19]

Poulsen

[11] Patent Number: 5,281,488

[45] Date of Patent: Jan. 25, 1994

[54] FOIL STRIP CONDUCTOR

[76] Inventor: Peder U. Poulsen, Huntington Rd. Box 197, Stratford, Conn. 06497

[21] Appl. No.: 944,835

[22] Filed: Sep. 15, 1992

[51] Int. Cl.[5] ..... H01B 11/06

[52] U.S. Cl. ..... 428/624; 428/126; 174/117 FF; 174/36

[58] Field of Search ..... 428/624, 626, 457, 458, 428/636, 126, 189; 174/117 FF, 117 F, 119 R, 133 R, 72 TR, 36, 35 MS; 156/54

[56] References Cited

U.S. PATENT DOCUMENTS

| | | | |
|---|---|---|---|
| 2,852,423 | 9/1958 | Bassett | 174/36 |
| 3,624,267 | 11/1971 | Plummer | 124/36 |
| 3,634,800 | 1/1972 | Fisher | 156/54 |
| 4,327,246 | 4/1982 | Kincaid | 174/36 |
| 4,645,549 | 2/1987 | Lalor | 156/54 |
| 5,023,395 | 1/1991 | O'Connor | 174/36 |

FOREIGN PATENT DOCUMENTS

| | | | |
|---|---|---|---|
| 2835415 | 2/1980 | Fed. Rep. of Germany | 174/117 FF |
| 1123668 | 9/1956 | France | 174/117 FF |
| 700459 | 12/1953 | United Kingdom | 174/117 FF |
| 973211 | 10/1964 | United Kingdom | 174/117 FF |
| 2033297A | 5/1980 | United Kingdom | 428/126 |
| 2103415A | 2/1983 | United Kingdom | 174/36 |

OTHER PUBLICATIONS

Lockwood Industries "-True-Shield Tape" Bulletins 115-116,119,121 Van Nuys, Calif., Oct. 1968.

AVL Industries, Inc. "Preformed Insulated Shielding and Foil Conductor Products" brochure, AVL-1000, AVL-3000, AVL-5000, AVL-7000 series. no date.

*Primary Examiner*—John Zimmerman

[57] ABSTRACT

Foil strip conductor comprising a continuous tape of dielectric material placed adjacent to and facing an equally wide band of a conductive material like e.g. copper foil on one side, and another, wider, dielectric tape facing the conductor on its opposite side, the overlapping edges of the wider of the two tapes being folded around the edges of the conductor and the first mentioned dielectric tape at the same time, and in the process being bonded to the outside surface of the first mentioned tape.

5 Claims, 1 Drawing Sheet

FOIL STRIP CONDUCTOR

BACKGROUND OF THE INVENTION

1. Field of the Invention

The present invention relates to laminated foil strip conductors consisting of a band or bands of metal foil or strip which are laminated onto or between dielectric materials in tape form. The materials are usually combined in a continuous process wherein the dielectrics are laminated onto one or both sides of the conductor or folded around it to fully or partially enclose it in an insulating sheath.

2. Background

Typical uses for foil strip conductors are as safety or grounding shields, or as electrostatic screens placed between the primary and secondary windings in transformers. Another use is as winding conductors replacing magnet wire in electric coils for the purpose of raising the space factor or to improve heat dissipation and/or high frequency performance.

A popular type of foil strip conductor consists of metal foil sandwiched between two layers of e.g. polyester film whereof only one is provided with a layer of pressure sensitive adhesive facing the foil strip. Typically in this type material the film layers are from 0.125" to 0.25" wider than than the conductor, and because the non adhesive film adheres to the margins of the opposite film layer but not to the metal it is comparatively easy to peel the sandwich open in order to attach a lead wire to the foil.

Although this type foil strip conductor has gained wide acceptance for many applications it is often considered a drawback that the conductor does not extend all the way to the edges and that the sandwich will sometimes open up unintentionally during application. In addition, often particles of adhesive present near the edges of the sandwich will stick to taping machines which may seize up unless cleaned regularly.

Another version of foil strip conductor, generally referred to as cuffed, comprises a film tape which is laminated onto one side of the foil and folded around both edges extending an equal amount towards the centerline on the other side of the foil. Normally, in the case of a cuffed conductor, an uncovered area is left in the middle which eliminates the need of peeling or stripping for attachment of a ground wire. The open area, however, increases the risk of shorted turns if the tape is accidentally twisted during application, and for this reason a fully enclosed, yet peelable product is preferred by many users.

The experience outlined in the above has led to the development of a variant which is used for similar purposes, comprising a a sheath of a non adhesive film which is folded around the metal strip and sealed on one side by an externally applied strip of adhesive tape. In this product the metal strip is not attached to the inside of the film envelope which may be cut and removed locally for attachment of lead wires. This construction is generally considered sturdier than the sandwich version described above, but still the sealing tape may rub off during rough handling leading to shorted turns in the coils.

SUMMARY OF THE INVENTION

The present invention aims towards alleviating the drawbacks described in the above and comprises a fully enclosed conductor extending substantially to the edges. Because the borders of the envelope are located at a distance from the edges and because of the absence of an externally applied sealing tape there is no risk of ripping the laminate open during application through interference from edge guides etc. As a result the foil strip conductor according to the invention is sturdier and safer to use and yet as easy to peel or strip open as any of the products described above.

The invention will be described in the following with reference to the drawing, in which

DESCRIPTION OF THE PREFERRED EMBODIMENT(S)

Figure 1:
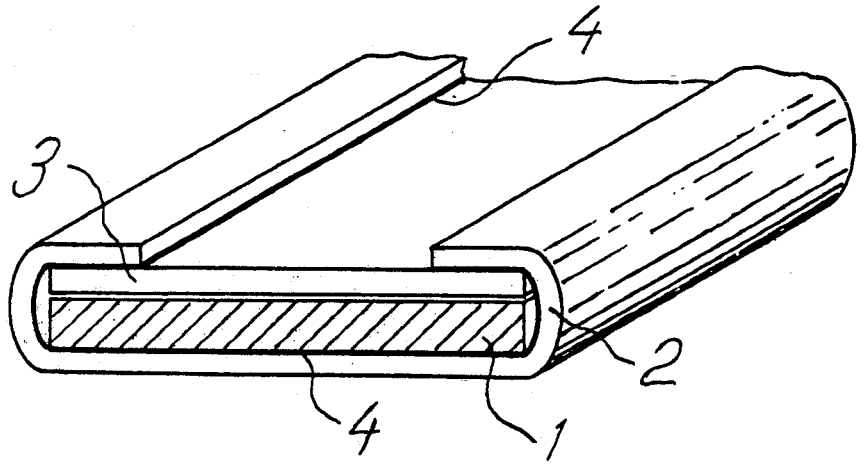
FIG. 1 is a cross section through a foil strip conductor according to the invention, wherein the insulating envelope is bonded to one side of the metal strip and not to the other, and, FIG. 2 a cross section through another embodiment of a foil strip conductor according to the invention, wherein there is no bond between the metal strip and its envelope.

In the embodiment of FIG. 1, the strip conductor 1 is partially surrounded by a tape 2 of a dielectric like e.g. polyester film which is folded around both edges of the conductor in the fashion of the cuffed product described above. According to the invention, in the same process another dielectric tape, 3, substantially as wide as the conductor, is placed adjacent its opposite side inside the partial envelope formed by tape 2. Tape 2 comprises a layer of adhesive material 4 on the side adjacent the conductor, the adhesive serving to bond the two components together and at the same time provide a bond between the folded around edges of tape 2 and the edges of the 3. Because of the absence of an adhesive on tape 3, in the laminating process it is not bonded to the metal foil, meaning that one side of the conductor may be laid bare easily by inserting a sharp instrument between the conductor and tape 3. Although in the above reference is made to an adhesive 4, it is understood that the bonding of the material may be accomplished without an adhesive as such, e.g. in a fusing process or the like.

Figure 2:
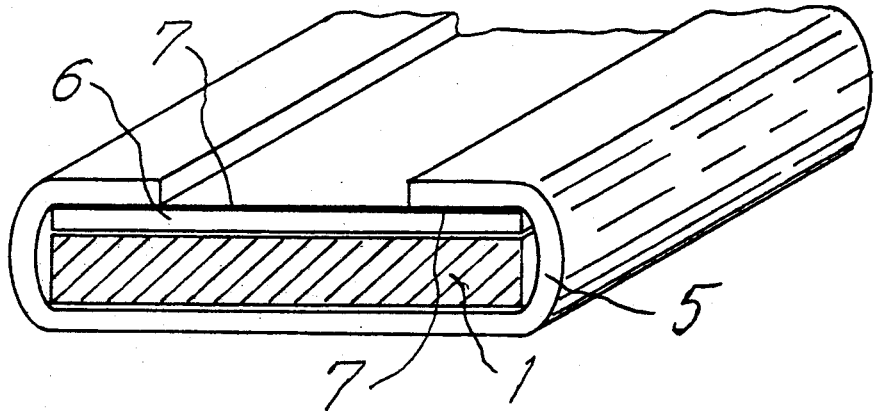

FIG. 2 illustrates a different embodiment of a foil strip conductor according to the invention, comprising a tape 5, without an adhesive, and a tape 6 provided with an adhesive layer 7, the effect being a product wherein there is no bond at all between the conductor and its insulating sheath, the sheath nevertheless being effectively sealed by means of the internally applied tape 6. Because of this feature it is an easy process to cut the sheath on both sides to remove it entirely in the same fashion as stripping a wire for termination.

Although the foil strip conductors illustrated in the drawings comprise only one strip conductor inside the dielectric envelope it is within the scope of the invention to enclose two or several conductors within the same sheath either contacting each other or insulated from one another. One category of this type product applying to both of the described embodiments of the invention, comprises a multitude of conductors substantially of the same width stacked one upon the other inside the same envelope. The purpose of this being either to increase the flexibility and pliability of the laminate or, by insulating the conductors from one another, to establish several electric paths inside the same sheath. Another way of creating a multi-conductor ribbon according to the invention is replacing the single conductor 1 with several narrower bands placed side by side, in a mutually spaced relationship. The multitude of individual conductors may be bonded either to the inside of tape 2 or 3, or to a separate substrate placed inside the envelope formed by the dielectric tapes.

The subject matter represented by the drawings and specification is only examples of foil strip conductors according to and defined by the invention, Since many combinations of materials and features are possible without departing from the scope of the invention, it is intended that all matter contained in the above description or shown in the accompanying drawings shall be interpreted as illustrative and not limited It is also understood that the following claims are intended to cover all of the generic and specific features of the invention herein described, and all statements of the scope of the invention which, as a matter of language, might be said to fall therebetween.

What is claimed is:

1. Foil strip conductor comprising a continuous tape of dielectric material placed adjacent to an equally wide band of conductive material on one side, and another, wider, dielectric tape facing the conductor on its opposite side covering the opposite side and including overlapping edges extending beyond the edges of the opposite side, the overlapping edges of the wider tape being folded around the edges of the conductor and the narrower tape at the same time, and bonded to the outside surface of the narrower tape.

2. Foil strip conductor according to claim 1, wherein the wider of the two dielectric tapes is also bonded to the conductive band.

3. Foil strip conductor according to claim 1 or 2, wherein the conductive band is a plurality of thinner conductors of equal width, stacked one upon the other, the individual bands being either bare, in mutual electrical contact, or insulated from one another.

4. Foil strip conductor according to claim 1 or 2, wherein the conductive band is a plurality of narrower conductors placed side by side in a mutually spaced relationship and bonded either to the inside of one of the two dielectric tapes or to a separate substrate tape placed inside the envelope formed by the other dielectric tapes.

5. Foil strip conductor according to claim 1, where the band of conductive material is copper foil.

* * * * *